United States Patent [19]

Vieira

[11] 4,382,600

[45] May 10, 1983

[54] GAMEBOARD WITH METALLIC BALL AND MAGNETIC TARGET AND VELOUR SURFACE

[76] Inventor: Frank Vieira, 1431 Alta Vista, Hollister, Calif. 95023

[21] Appl. No.: 254,323

[22] Filed: Apr. 14, 1981

[51] Int. Cl.[3] ..... A63F 7/00

[52] U.S. Cl. ..... 273/118 R; 273/85 R; 273/129 K

[58] Field of Search ..... 273/1 M, 6, 85 R, 87.2, 273/90, 118 R, 118 A, 123 A, 129 R, 129 K, 129 W, DIG. 9

[56] References Cited

U.S. PATENT DOCUMENTS

| | | | |
|---|---|---|---|
| 1,038,429 | 9/1912 | Penny | 273/129 K UX |
| 3,596,576 | 8/1971 | Cicero | 273/DIG. 9 UX |
| 4,179,122 | 12/1979 | Ray | 273/85 R |
| 4,274,635 | 6/1981 | Pakogian | 273/85 R |

FOREIGN PATENT DOCUMENTS

| | | | |
|---|---|---|---|
| 2333073 | 1/1975 | Fed. Rep. of Germany | 273/85 R |
| 2353397 | 5/1975 | Fed. Rep. of Germany | 273/85 R |
| 580925 | 9/1946 | United Kingdom | 273/118 A |

*Primary Examiner*—Richard T. Stouffer
*Attorney, Agent, or Firm*—John L. McGannon

[57] ABSTRACT

Apparatus for playing a game using a ball as a player piece movable over the upper surface of a gameboard having side and end walls. The ball is propelled over the gameboard surface by a paddle or a striking member which is hand-held and has a hole through it for sighting the ball before the ball is struck. The gameboard has a plurality of spaced pins projecting upwardly from the upper surface thereof to present obstacles which can be struck with a ball as it is propelled forwardly. A pair of goals are at opposite ends of the gameboard, the goals being defined by wickets. Preferably, the ball is of metal and each goal has a magnet behind the corresponding wicket to attract the ball after it enters the wicket. A layer of fabric material covers the upper surface of the gameboard and the inwardly facing surfaces of the side and end walls. The material has a pile or fuzziness which allows uniform movement of the ball over the gameboard surface without the need for leveling the gameboard.

1 Claim, 4 Drawing Figures

GAMEBOARD WITH METALLIC BALL AND MAGNETIC TARGET AND VELOUR SURFACE

This invention relates to games and, more particularly, to a game apparatus of the type having a gameboard, a player piece movable over the gameboard, and a paddle or striking member for striking the player piece for causing it to move over the gameboard surface.

BACKGROUND OF THE INVENTION

It is well known to provide a game apparatus in which a player piece, such as a ball, is struck and moved over the upper surface of a gameboard from one location to another and into a goal for making a score of the game. The gameboard is relatively small in size so that is can be mounted on a suitable surface, such as a table top or the like.

Several embodiments of this type of game include U.S. Pat. Nos. 829,947 and 1,504,605 and British Pat. No. 2028. Each of these references discloses a gameboard having a player piece, such as a ball or disk, movable over the upper surface of the gameboard by a paddle or stick, the gameboard having spaced pins projecting upwardly from the upper surface thereof to present obstacles to the movement of the player piece. Generally, these gameboards must be leveled because they have flat, hard, smooth upper surfaces which allows the player piece, if it is a ball, to move unrestrictedly over the surface except when the ball strikes one or more of the pins projecting upwardly from the gameboard surface. If the surface is not level, the balls tends to move to the lowest point on the board. Leveling of the board is extremely tedious and time consuming; thus, unless the leveling is sufficiently accurate, the play of the game loses its entertainment value and interest in the game diminishes.

Because of the aforesaid drawback, a need has arisen for an improved game apparatus of the type described which permits the gameboard to be relatively small in size yet does not need to be accurately leveled to use the game apparatus.

Other disclosures in the gameboard art of the type using player pieces or sticks for striking the player pieces include U.S. Pat. Nos. 1,624,469 and 3,158,373.

SUMMARY OF THE INVENTION

The present invention is directed to game apparatus having a gameboard of relatively small size, a ball serving as a player piece movable over the upper surface of the gameboard, and a paddle, stick or striker member which is adapted to be hand-held and to be moved in a manner to strike the ball to cause the ball to move toward one of a pair of goals at the opposite ends of the gameboard. The gameboard is covered with a fabric material preferably of synthetic material, such as a polyester, acetate or a combination of polyester and acetate. The material is provided with a pile or one surface which forms the upper surface of the gameboard. This surface effectively permits uniform movement of the ball over the gameboard surface so that, even if the gameboard surface is not completely level, the ball will still move substantially in the direction of the force applied by the ball by the striker member until the ball comes to a halt or is deflected by one or more spaced pins projecting upwardly from the upper surface of the gameboard, the pins defining obstacles to the movement of the ball.

The gameboard has a pair of opposed sides and a pair of opposed ends, the sides and ends having inwardly facing surfaces which are covered with the material covering the upper surface of the gameboard. Thus, the ball striking a side or end will be permitted to rebound, at least to some degree, back into the playing area of the gameboard rather than to stop immediately after striking a side or end.

The gameboard is provided with a pair of goals near opposed ends thereof, each goal defining a wicket spaced inwardly from the adjacent end. Preferably, the player piece is comprised of a metallic ball and each goal has a magnet behind the wicket to present a magnetic field which attracts the metal ball if the metal ball is aligned with the wicket and adjacent thereto. This adds to the enjoyment of the playing of the game with the game apparatus of this invention because the attraction of the ball by a magnet provides a true indication that a goal has been made since the ball remains in contact with the magnet after a goal has been made.

The primary object of the present invention is to provide an improved game appartus of the type having a gameboard provided with spaced pins projecting upwardly from the upper surface thereof to present obstacles for a player piece in the form of a ball which is struck by a hand-held paddle or striker member wherein the gameboard has surface means thereon to permit uniform movement of the ball after being struck by the striker member even though the gameboard is not completely leveled to thereby provide a game apparatus which can be of small size, suitable for table top use, yet the playing of the game with the game apparatus provides enjoyment of young and old alike and stimulates the interest of the game players to play the game for long periods of time without interruption.

Other objects of this invention will become apparent as the following specification progresses, reference being had to the accompanying drawing for an illustration of this invention.

IN THE DRAWING

Figure 1:
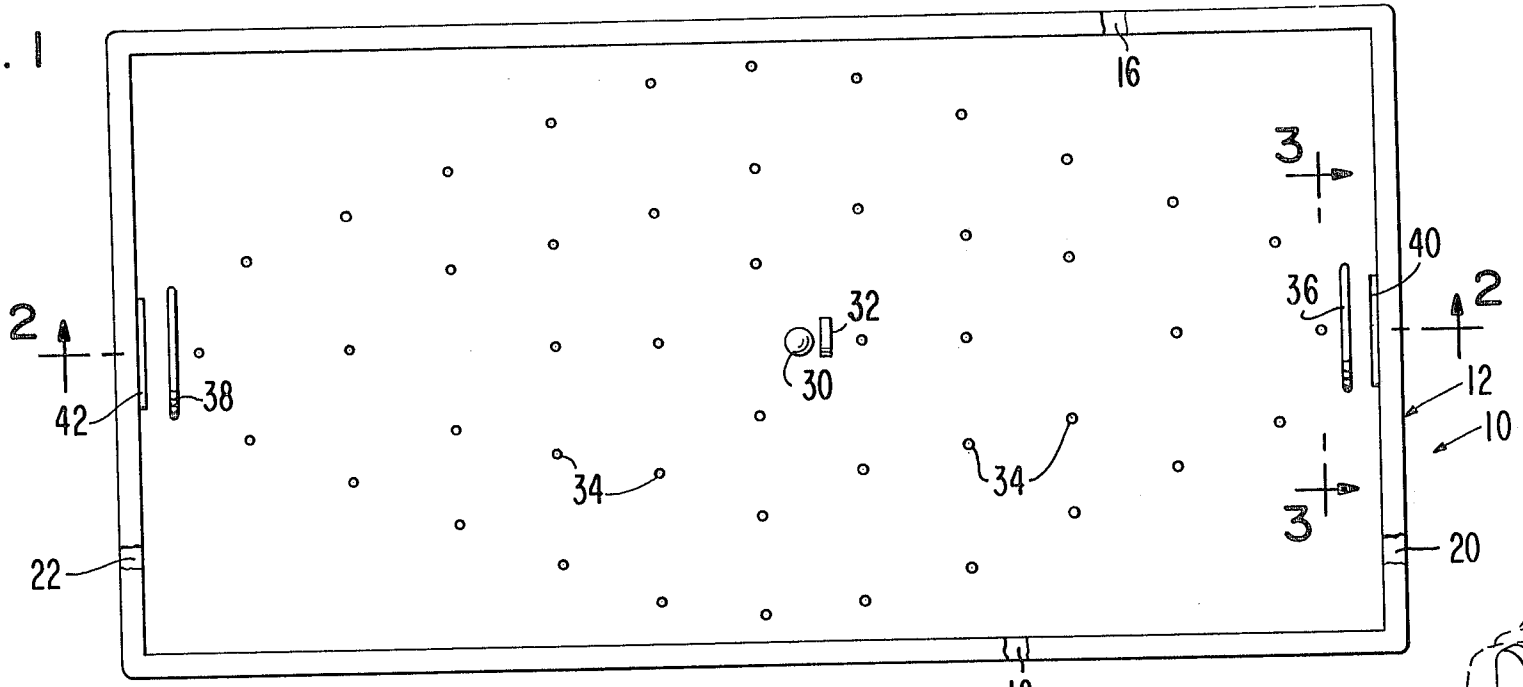
FIG. 1 is a top plan view of the gameboard of the present invention showing a ball-like player piece on the upper surface of the gameboard, and a hand-held paddle for use in striking the ball to propel it across the upper surface of the gameboard.

The game apparatus of the present invention is broadly denoted by the numeral 10 and includes a gameboard 12 having a base 14 of plywood or other suitable material. The gameboard further has a pair of spaced, sides 16 and 18 and a pair of spaced ends 20 and 22. The sides and ends define a playing area and are preferably of wood. The upper, flat surface of base 14 is covered with a layer or sheet 24 of a fabric material, preferably a synthetic material, such as polyester, acetate, or a combination of polyester and acetate. A suitable material is of a type known as a velour which has a pile or fuzziness on the upper surface thereof and a smooth, knitted, generally flat lower surface. The material is often used in making bathrobes and the like.

Figure 2:
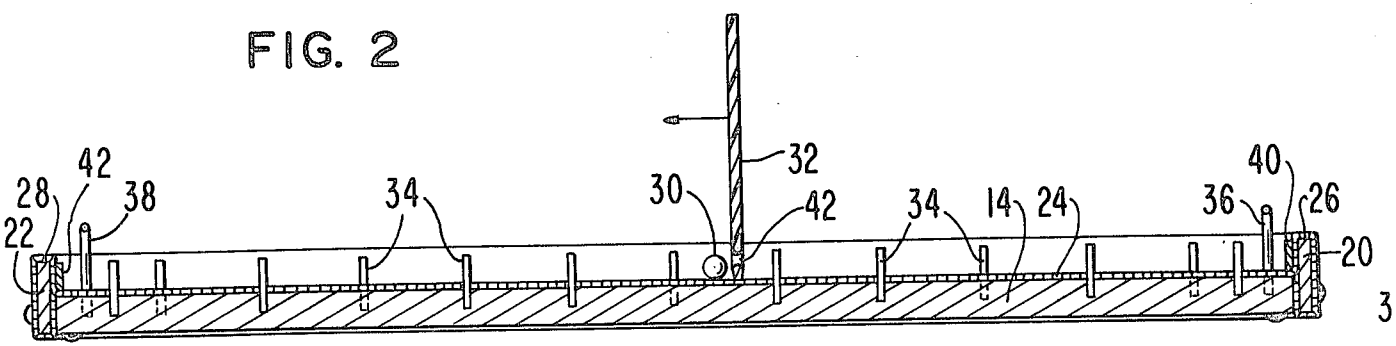
FIG. 2 is a cross-sectional view taken along line 2—2 of FIG. 1.

The pile on the upper surface of layer 24 is relatively short, such as 1/64-inch to 1/32. Also, sides 16 and 18 and ends 20 and 22 are provided at least on the inner surfaces thereof with the same material as layer 24. As shown in FIG. 2, ends 20 and 22 are completely covered with layers 26 and 28 with the same material as layer 24. The outer surfaces of layers 26 and 28 are provided with a pile or fuzziness in the same manner as the outer surface of layer 24.

Figure 4:
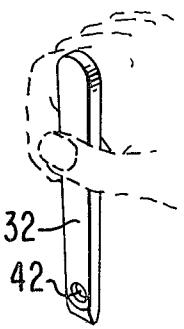
FIG. 4 is a perspective view of the paddle used for striking the player piece, showing the way the paddle is held in the hand.
Figure 3:
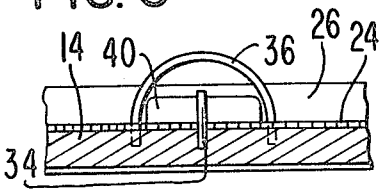
FIG. 3 is a fragmentary cross-sectional view taken along line 3—3 of FIG. 1.

A player piece in the form of a ball 30 forms part of game apparatus 10. Ball 30 is adapted to be struck by a paddle or striker member 32 which is hand-held in a manner shown in FIG. 4.

The upper surface of gameboard 12 is provided with a plurality of spaced pins 34 which can be arranged to form a pattern in the manner shown in FIG. 1. The pins are used to present obstacles for deflecting or stopping the movement of player piece 30 after it has been struck by striker member 30.

Gameboard 12 has a pair of goal posts 36 and 38 adjacent to respective ends 20 and 22. The goal posts are in the form of wickets having their ends extending into the gameboard. The wickets are spaced inwardly from respective ends 20 and 22 by a short distance, such as about one inch.

Ball 30 may be of a magnetically attractive material, such as steel or the like. To this end, a pair of magnets 40 and 42 are secured in any suitable manner to the inner surfaces of sides 20 and 22, respectively behind the respective wickets 36 and 38. Thus, when ball 30 is near either wicket and the ball enters the wicket, the ball is attracted to the adjacent magnet and the ball with move into contact with the magnet, signifying a goal has been made.

Striker member 32 has a hole 42 near its normally lowermost end. This hole permits the player to sight through the striker member to see the ball and to align the striker member properly with the ball. Typically, there will be two players and each player has a striker member 32. One of the players strikes the ball and, if the ball does not go into a goal, the other player has a turn at striking the ball. The players then alternate until a goal is made. After a goal, the ball is brought back to the center of the gameboard and play of the game is restarted. The game resembles the game of soccer with the pins 34 representing players on the soccer field. Whereas, in a standard soccer game, the players of one team may keep possession of the ball for a certain period of time, the play of game 10 is preferably such that the players alternate in striking ball 30.

The bottom of base 14 may be provided with tacks 46 which define feet or supports for gameboard 12. However, these may not be necessary if base 14 is sufficiently flat to permit the upper surface to be generally level. Also, the purpose of using the fabric material with a pile or fuzziness on the upper surface for covering base 14 is to avoid the need for leveling base 14. If the gameboard had no covering and had merely a hard, upper surface such as the surface of a plywood board, leveling would be required. Any reasonable level support, such as a table top will be suitable for use in mounting gameboard 12 for play since the fabric material of layer 24 will essentially permit uniform movement of ball 30 regardless of the location of the ball on the upper surface of a gameboard.

Ball 30 can be a marble, if desired. The marble can be of glass, agate or a suitable ceramic material. Preferably, however, the ball is a metal which is attracted by magnets 40 and 42.

What is claimed is:

1. Game apparatus comprising: a gameboard having a base, a pair of spaced sides, and a pair of spaced ends, the sides and ends being secured to the base at the outer periphery thereof to define a playing area; a layer of fabric material on the upper surface of the base and on the surfaces of the sides and end facing the playing area, the material being of a velour having a pile on the upper surface thereof and a smooth knitted, generally flat lower surface; a plurality of pins secured to and extending upwardly from the base in the playing area; means defining a pair of goals near respective ends of the gameboard, each goal comprising a wicket spaced from the respective end of the gameboard and a magnet coupled to the respective end of the gameboard, the magnet being above the layer of fabric material on said upper surface of the base and in alignment with the adjacent wicket; a metallic ball defining a player piece and capable of being attracted by the magnet, said ball being movable over the upper surface of the material on the base and engagable with the material on the sides and ends, the spacing between the pins being great enough to allow the ball to pass between the pins; and at least one elongated striker member adapted to be hand-held at one end thereof in a generally upright position for striking the ball to move the ball over the upper surface of the material on the base, whereby the ball can be struck and moved toward and into a goal to result in a score of the game, and striker member having a hole therethrough near the opposite end thereof in alignment with the longitudinal axis of the striker member to permit viewing of the ball before the ball is struck by the striker member.

* * * * *